US011617455B2

(12) United States Patent
Houdashell et al.

(10) Patent No.: US 11,617,455 B2
(45) **Date of Patent: *Apr. 4, 2023**

(54) SYSTEM AND METHOD FOR ROTATING AN ORNAMENT FOR THE PURPOSE OF DECORATING THE ORNAMENT

(71) Applicant: Hey Buddy Hey Pal Investments LLC, Amarillo, TX (US)

(72) Inventors: Gale Scott Houdashell, Amarillo, TX (US); Charles Curtis McGill, Amarillo, TX (US)

(73) Assignee: Hey Buddy Hey Pal Investments LLC, Amarillo, TX (US)

( * ) Notice: Subject to any disclaimer, the term of this patent is extended or adjusted under 35 U.S.C. 154(b) by 176 days.

This patent is subject to a terminal disclaimer.

(21) Appl. No.: 16/938,667

(22) Filed: Jul. 24, 2020

(65) Prior Publication Data

US 2020/0352361 A1 Nov. 12, 2020

Related U.S. Application Data

(63) Continuation-in-part of application No. 16/742,752, filed on Jan. 14, 2020, now abandoned, which is a continuation of application No. 15/900,402, filed on Feb. 20, 2018, now Pat. No. 10,531,749.

(60) Provisional application No. 62/460,973, filed on Feb. 20, 2017.

(51) Int. Cl.
*A47F 5/025* (2006.01)
*A47F 3/00* (2006.01)

(52) U.S. Cl.
CPC ..... *A47F 5/025* (2013.01); *A47F 3/00* (2013.01)

(58) Field of Classification Search
CPC ... A47F 5/025; A47F 5/02; A47F 3/00; B05B 15/12
USPC ..... 312/114
See application file for complete search history.

(56) References Cited

U.S. PATENT DOCUMENTS 1,760,344 A 5/1930 Charavay
2,956,357 A * 10/1960 Rakes ..... A47G 33/126 40/457
3,006,111 A 10/1961 Koch
3,829,348 A 8/1974 Spiegel et al.
3,847,116 A 11/1974 Prichard
3,848,564 A * 11/1974 Kull ..... B44D 3/00 33/18.1
4,173,667 A 11/1979 Rusch
(Continued)

*Primary Examiner* — Daniel J Troy
*Assistant Examiner* — Timothy M Ayres
(74) *Attorney, Agent, or Firm* — LaMorte & Associates P.C.

(57) ABSTRACT

A system and method for rotating an ornament, so that the ornament can be easily decorated. The decorating device has a housing that defines an interior compartment. Within the interior compartment, a mount receives and engages the neck of the ornament, therein temporarily connecting the ornament neck to the mount. The ornament is passed into the housing through an access opening in the housing. When connected to the mount in the housing, at least some of the ornament extends out of the housing through the access opening. A motor is used to rotate the mount and ornament. As the ornament rotates, the section of the ornament that extends out of the access opening can be contacted with marking devices. In this manner, the ornament can be decorated as it spins.

10 Claims, 7 Drawing Sheets

(56) References Cited

U.S. PATENT DOCUMENTS

| | | | | | |
|---|---|---|---|---|---|
| 4,285,746 | A | | 8/1981 | DePuy et al. | |
| 4,757,986 | A | * | 7/1988 | Hwang | A63H 33/00 472/6 |
| 4,852,283 | A | | 8/1989 | Teng | |
| 4,980,608 | A | | 12/1990 | Morrison | |
| 4,996,087 | A | | 2/1991 | Rebstock | |
| 5,134,778 | A | | 8/1992 | MacCarthy | |
| 5,280,682 | A | * | 1/1994 | Fussell | A47G 33/0809 40/409 |
| 5,286,535 | A | | 2/1994 | Hou | |
| 5,393,578 | A | * | 2/1995 | Yang | A47G 33/0809 428/7 |
| 5,399,391 | A | | 3/1995 | Perez-Viera et al. | |
| 5,513,084 | A | | 4/1996 | Simpson | |
| 5,675,921 | A | * | 10/1997 | Lin | G09F 19/08 74/665 GC |
| 5,696,333 | A | | 12/1997 | Shih | |
| 5,875,577 | A | * | 3/1999 | Lu | G09F 19/08 40/410 |
| 5,918,393 | A | | 7/1999 | Martell | |
| 6,053,322 | A | | 4/2000 | Kim et al. | |
| 6,357,151 | B1 | | 3/2002 | Yuen | |
| 6,467,623 | B1 | | 10/2002 | Lewis et al. | |
| 6,568,107 | B2 | | 5/2003 | Yuen | |
| 7,540,622 | B1 | * | 6/2009 | Bechtol | F21S 10/02 362/121 |
| 9,865,017 | B2 | * | 1/2018 | Huber | G06Q 30/08 |
| 10,531,749 | B1 | | 1/2020 | Houdashell | |
| D958,667 | S | * | 7/2022 | Houdashell | D9/635 |
| 2008/0067086 | A1 | | 3/2008 | Uidi | |
| 2008/0110066 | A1 | | 5/2008 | Peroni | |
| 2010/0187736 | A1 | | 7/2010 | Hutson | |
| 2011/0041669 | A1 | * | 2/2011 | Hermanson | A47G 33/0809 84/94.1 |
| 2011/0121212 | A1 | | 5/2011 | Chen | |
| 2016/0230966 | A1 | * | 8/2016 | DeFrancesco | F21V 3/02 |
| 2021/0008589 | A1 | * | 1/2021 | Houdashell | B44D 3/00 |

* cited by examiner

SYSTEM AND METHOD FOR ROTATING AN ORNAMENT FOR THE PURPOSE OF DECORATING THE ORNAMENT

RELATED APPLICATIONS

This application is a continuation-in-part of U.S. patent application Ser. No. 16/742,752, filed Jan. 14, 2020, which is a continuation-in-part of U.S. patent application Ser. No. 15/900,402, filed Feb. 20, 2018, now U.S. Pat. No. 10,531,749, which claims benefit of Provisional Patent Application No. 62/460,973 filed on Feb. 20, 2017.

BACKGROUND

1. Field of the Invention

In general, the present invention relates to systems and methods for rotating an ornament, such as a hanging Christmas tree ornament. More particularly, the present invention relates to systems and methods for rotating an ornament so that the ornament can be decorated as the ornament turns.

2. Prior Art Description

Many people enjoy making and/or decorating ornaments, such as Christmas tree ornaments. Some people make the entire ornament. Others like to buy pre-made ornaments and add decorations and colors to those ornaments. In either scenario, the ornament is typically decorated by hand. The ornament is either held in one hand while being decorated or is placed on a surface while it is decorated. The problem with this process is that only one side of the ornament is exposed for decoration. If paint or glue is being applied to the ornament, then the exposed side of the ornament must dry before the ornament can be flipped and the opposite side decorated.

One way to make the ornament decorating process more efficient is to mount the ornament in a manner that enables the ornament to rotate while it is being decorated. Many ornaments, such as Christmas tree ornaments, are intended to be hung by a hook. As such, the ornament is typically supplied with some type of eye loop at its topmost position to provide a structure for attaching the hook.

An ornament with a hook can readily be hung as it is decorated. Furthermore, there are many commercial products intended to cause hanging ornaments to rotate as they hang. Such prior art is exemplified by U.S. Pat. No. 4,980,608 to Morrison. As such, a hanging ornament can be hung and rotated during the decoration process. However, this solution creates other problems. A hanging ornament will hang vertically with its center of gravity under the axis of the hanging hook. If any lateral forces are applied to the hanging ornament, the ornament will sway away from its vertical alignment. As soon as the lateral force is removed, the ornament will swing back towards its original orientation and a swinging oscillation will begin. As a result, when a hanging ornament is contacted during the decoration process, the ornament will move and begin to swing. It is very difficult to decorate a swinging ornament. Accordingly, the ornament must be held still, therein preventing the ornament from rotating and eliminating the benefit of hanging the ornament.

Ornament decorators often compromise when decorating hanging ornaments. An ornament being decorated is placed on a rotating platform. The rotating platform causes the ornament to rotate so that the ornament can be decorated.

However, the surface of the ornament that rests upon the platform cannot be decorated. As a result, the ornament must be manually flipped on the platform in order to fully decorate the ornament. Support platforms that rotate objects are exemplified by U.S. Patent App. Pub. No. 2008/0067086, to Uidl.

A need therefore exists for a system and method specifically designed to rotate a hanging ornament while the ornament is being decorated that both prevents the ornament from swinging and exposes all relevant surfaces of the ornament to the decorator. This need is met by the present invention as described and claimed below.

SUMMARY OF THE INVENTION

The present invention is a system and method for rotating an ornament, so that the ornament can be easily decorated. The ornament has a body and a neck, wherein the neck is disposed about a central axis.

The decorating device has a housing that defines an interior compartment. Within the interior compartment, a mount receives and engages the neck of the ornament, therein temporarily connecting the ornament neck to the mount. The ornament is passed into the housing through an access opening in the housing. When connected to the mount in the housing, at least some of the ornament extends out of the housing through the access opening.

A motor is used to rotate the mount. As the mount rotates, the ornament attached to the mount rotates. As the ornament rotates, the section of the ornament that extends out of the access opening can be contacted with marking devices. In this manner, the ornament can be decorated as it spins. Once decorated, the ornament is detached from the mount and is ready for use.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention ornament decoration system can be embodied in many ways, a few exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered limitations when interpreting the scope of the appended claims.

Figure 1:
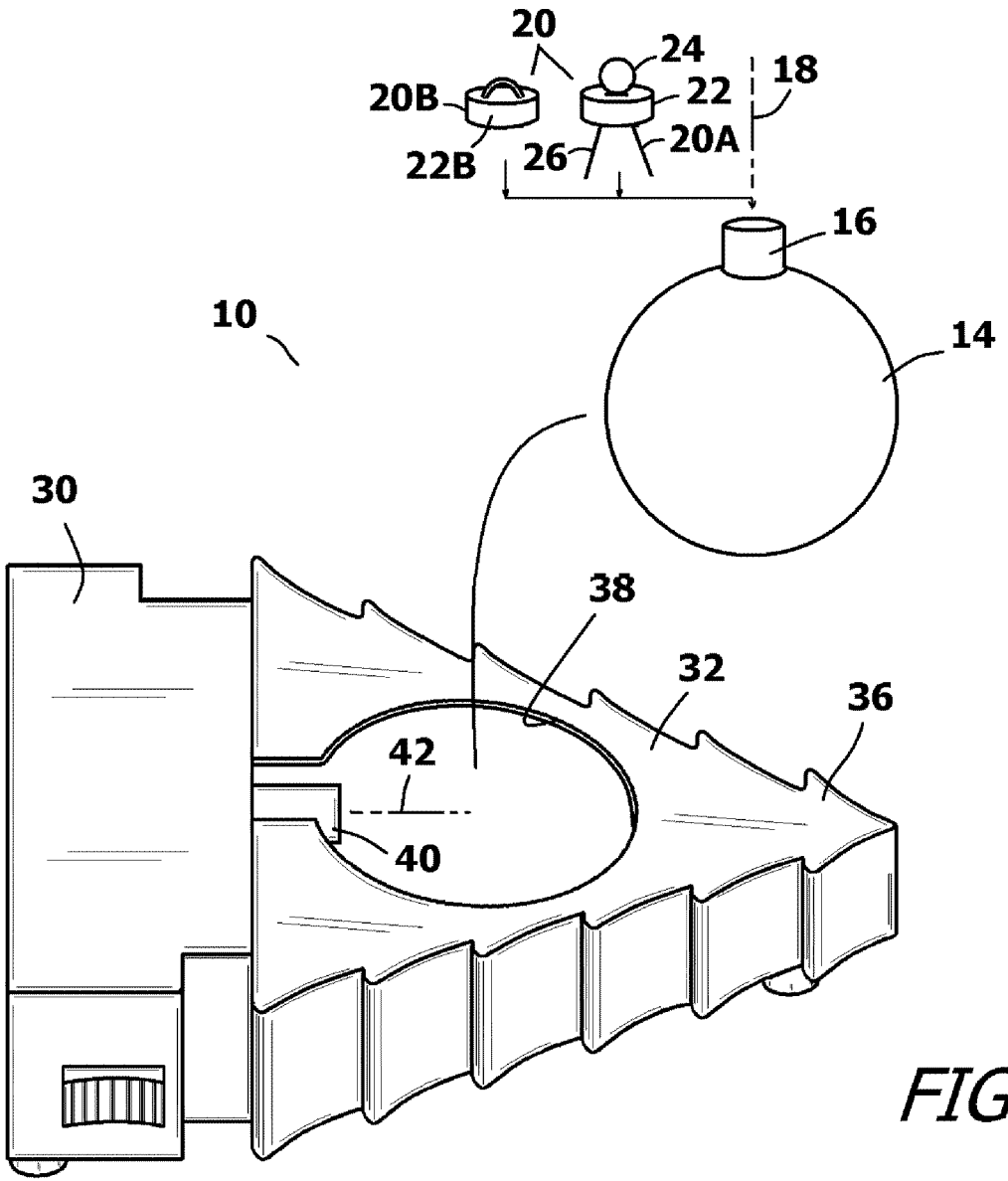
FIG. 1 shows an exemplary embodiment of a decorating system connected to an ornament with the ornament in the process of being decorated.
Figure 2:
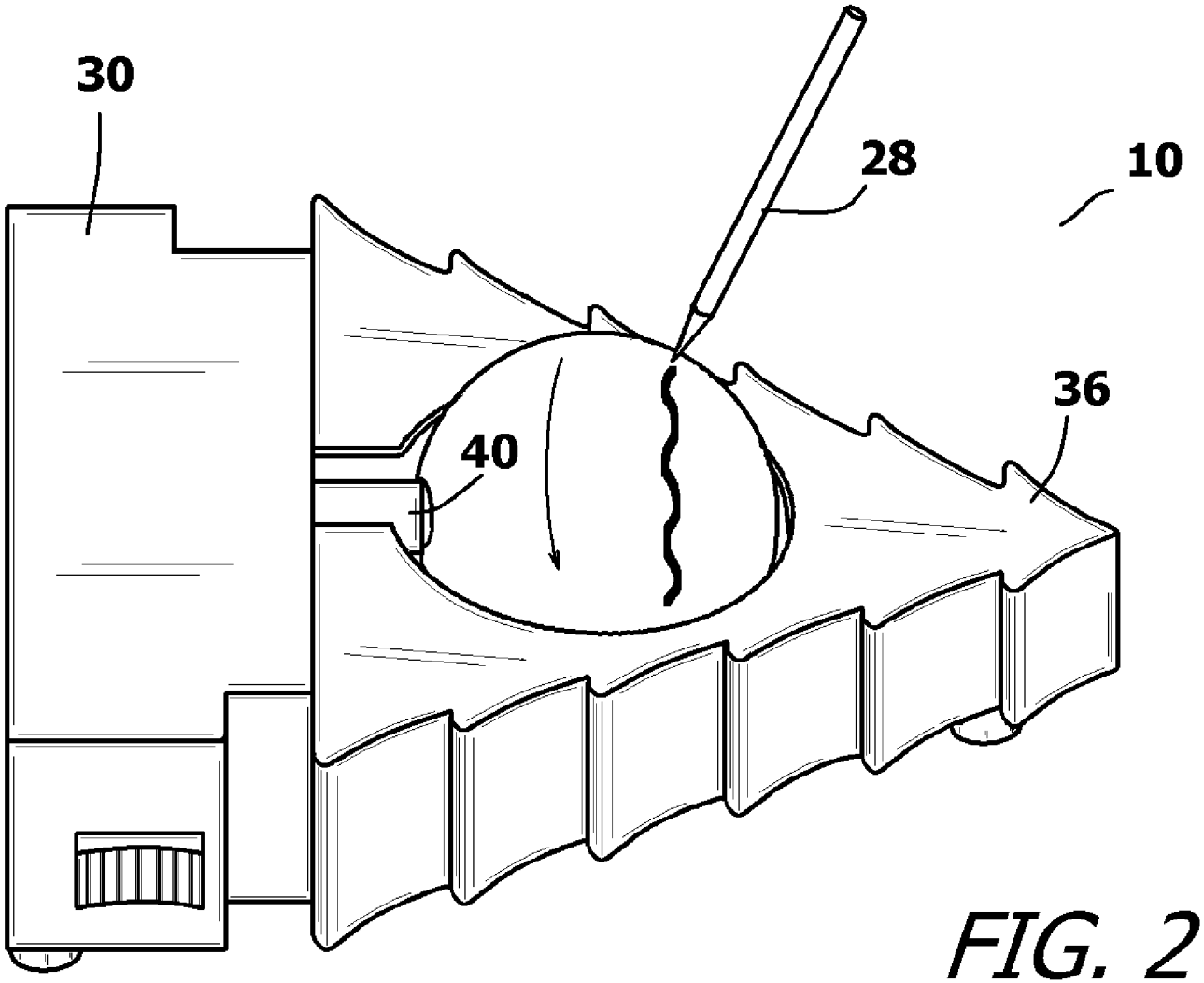
FIG. 2 shows the decorating system of FIG. 1, with the ornament detached from the decorating system and disassembled.
Figure 3:
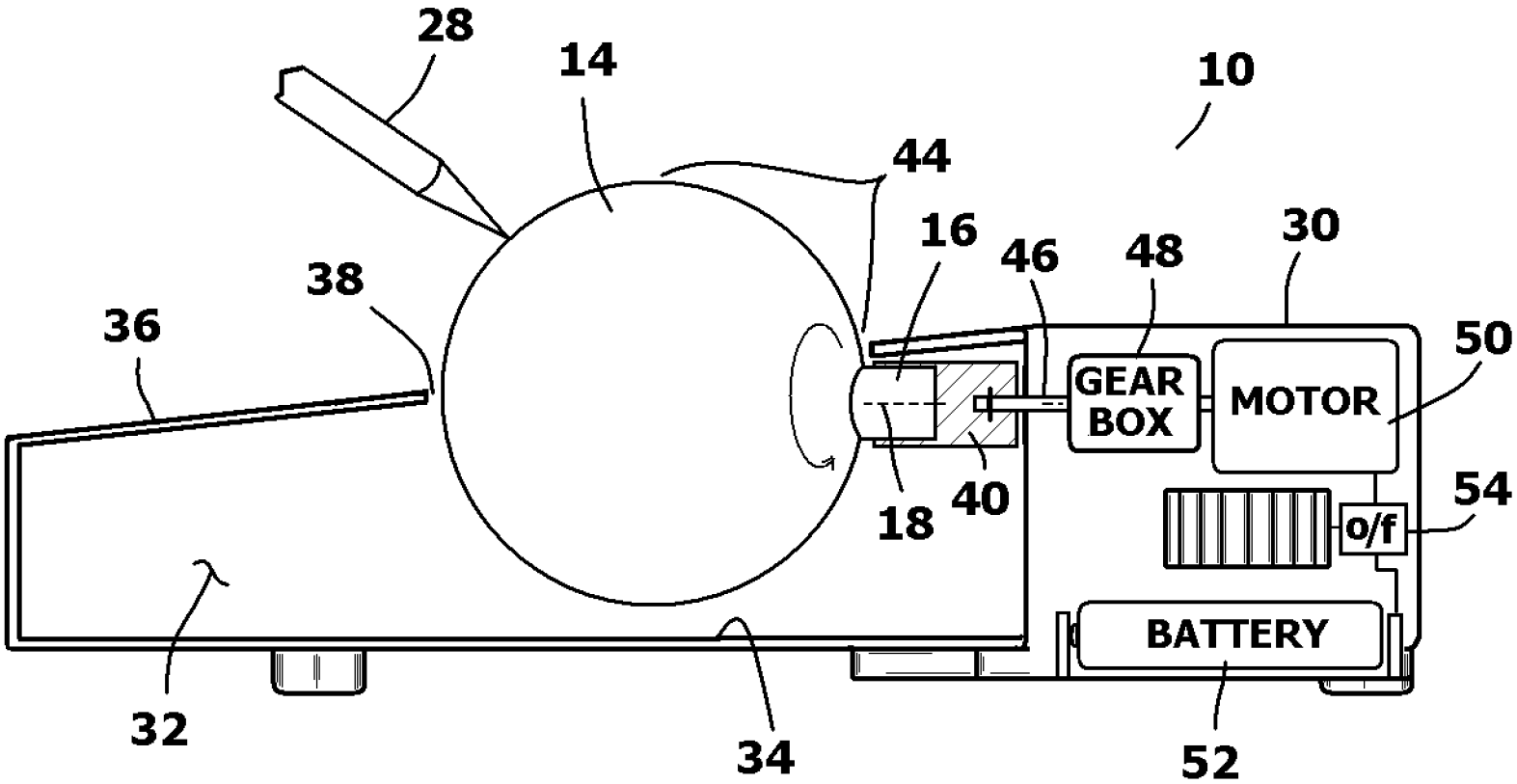
FIG. 3 is a cross-sectional view of the exemplary embodiment of FIG. 1 showing the primary components of the decorating system.

Referring to FIG. 1, in conjunction with FIG. 2 and FIG. 3, an ornament decorating system 10 is shown that is intended for use in decorating a hanging ornament 12, such as a hanging Christmas tree ornament. A hanging ornaments 12, such as a hanging Christmas tree ornament, has a body 14 and a neck 16. The ornament body 14 is often ball shaped. However, elongated shapes are also commonplace. Regardless of shape, the ornament body 14 is typically symmetrically disposed around a central axis 18. The ornament neck 16 is positioned at the top of the ornament body 14 and is concentric with the central axis 18. The neck 16 is terminated with an ornament cap 20. The ornament cap 20 has a small crown 22 that covers the neck 16 and an eye loop 24. The eye loops 24 facilitate the attachment of a hanging hook to the ornament 12. Since the ornament cap 20 is in-line with the central axis 18 of the hanging ornament 12, the ornament 12 will hang straight vertically from the ornament cap 20. There are two types of ornament caps 20 in wide use. In the first type of ornament cap 20A, the eye loop 24A is part of a spring with long arms 26. The arms 26 extend into the neck 16 of the hanging ornament 12 and join the ornament cap 20A to the hanging ornament 12. The second type of ornament cap 20B engages the neck 16 of the hanging ornament 12 with the crown 22B of the ornament cap 20B. That is, the crown 22B of the ornament cap 20B joins to the neck 16 of the hanging ornament 12 with either a mechanical connection and/or an adhesive connection.

The ornament decorating system 10 temporarily engages the neck 16 of the hanging ornament 12 in a manner that prevents the hanging ornament 12 from tilting or swaying during the decoration process. The ornament decorating system 12 rotates the hanging ornament 12 about the central axis 18 of the hanging ornament 12. As the hanging ornament 12 is rotated, the hanging ornament 12 can be contacted with marking devices 28, such as ink markers, pens, pencils, chalk, paint brushes or crayons. Likewise, the hanging ornament 12 can be contacted by glue applicators, stickers, or other such decorations. Since the neck 16 of the hanging ornament 12 is firmly affixed to the ornament decorating system 10, the contact forces do not alter the orientation of the hanging ornament 12 as it rotates. In this manner, all the surfaces of the hanging ornament 12 are exposed for decoration except for a small section of the neck 16 that is in contact with the ornament decorating system 10. This section of the neck 16 is subsequently enclosed, in whole or in part, by the ornament cap 20 when the decoration of the hanging ornament 12 is completed.

The ornament decorating system 10 includes a housing 30. The housing 30 can have any shape, provided the housing 30 defines an interior compartment 32. The interior compartment 32 has a base surface 34 and an opposite face surface 36. An access opening 38 is formed in the face surface 36 to provide access to the interior compartment 32. Although the opening 38 can be any shape, the shape of the opening 38 preferably mimics the shape of the hanging ornament 12 that is to be decorated. The face surface 36 can be inclined relative to the plane of the base surface 34 for a purpose that is later explained.

A mount 40 is disposed within the interior compartment 32. The mount 40 is configured to interconnect with the neck 16 of the hanging ornament 12. The mount 40 rotates about a rotational axis 42. When the neck 16 of the hanging ornament 12 is connected to the mount 40, the rotational axis 42 of the mount 40 aligns with the central axis 18 of the hanging ornament 12, therein causing the hanging ornament 12 to rotate about its central axis 18. When the neck 16 of the hanging ornament 12 is connected to the mount 40, the hanging ornament 12 extends from the mount 40 as a cantilever. That is, no part of the hanging ornament 12, other than the neck 16, is in contact with the ornament decorating system 10.

The mount 40 is located within the interior compartment 32 of the housing 30. The mount 40 is accessed by advancing the hanging ornament 12 into the access opening 38 in the face surface 36 of the housing 30. The access opening 38 is larger than the hanging ornament 12. In this manner, the hanging ornament 12 is easily manipulated within the confines of the access opening 38. Furthermore, the access opening 38 does not interfere with the ability of the hanging ornament 12 to rotate.

The mount 40 is positioned close to the face surface 36 of the housing 30. In this manner, the hanging ornament 12 will partially extend out of the housing 30, through the access opening 38, when attached to the mount 40. This creates an exposed section 44 of the hanging ornament 12 that extends out of the housing 30. When the hanging ornament 12 rotates, preferably all the surfaces of the ornament body 14 rotate into the exposed section 44 at various times. As previously mentioned, the face surface 36 may be inclined. The incline of the face surface 36 slopes away from the rotational axis 42 of the mount 40. In this manner, the exposed section 44 is increased in area. The hanging ornament 12 is decorated by contacting the exposed section 44 of the hanging ornament 12 with a marking device 28 or an applicator. For example, marking devices 28, such as colored ink markers can be provided. These marking devices 28 can be touched to the hanging ornament 12 as it rotates, therein transferring a colored design onto the hanging ornament 12. All surfaces of the hanging ornament 12 can be contacted with the exception of the section of the ornament neck 16 in contact with the mount 40.

Referring to FIG. 3, it can be seen that within the housing 30, the mount 40 is connected to a drive shaft 46. The drive shaft 46 is turned by a gearbox 48. The gearbox 48 is turned by an electric motor 50. The electric motor 50 is powered by batteries 52. The operation of the motor 50 is controlled by and on/off switch 54 that can be accessed on the exterior of the housing 30.

Figure 4:
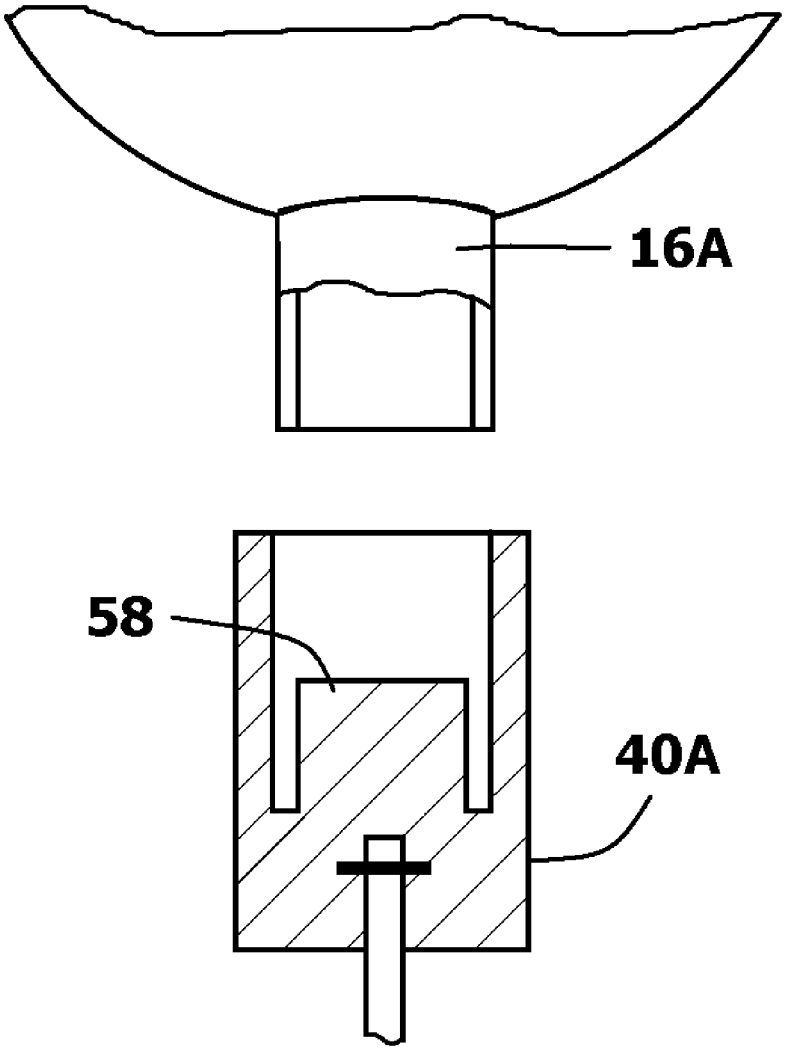
FIG. 4 is a fragmented cross-sectional view showing a neck of an ornament and a first exemplary embodiment of a mount.

The mount 40 is shaped and sized to engage the neck 16 of the hanging ornament 12. If the ornament decorating system 10 is sold with ornaments or is sold for use with a particular type of ornament, then the mount 40 can be configured to match the neck 16 or those ornaments. Some examples are as follows. Referring to FIG. 4, the neck 16A of a traditional glass hanging ornament is shown. To engage such a neck 16A, the mount 40A can be configured with a receptacle 56 that receives a portion of the neck 16A and engages the neck 16A with a friction connection. A support plug 58 is provided that passes into the neck 16A. This provides additional friction and provides structural integrity to the glass neck 16A during the decorating process.

Figure 5:
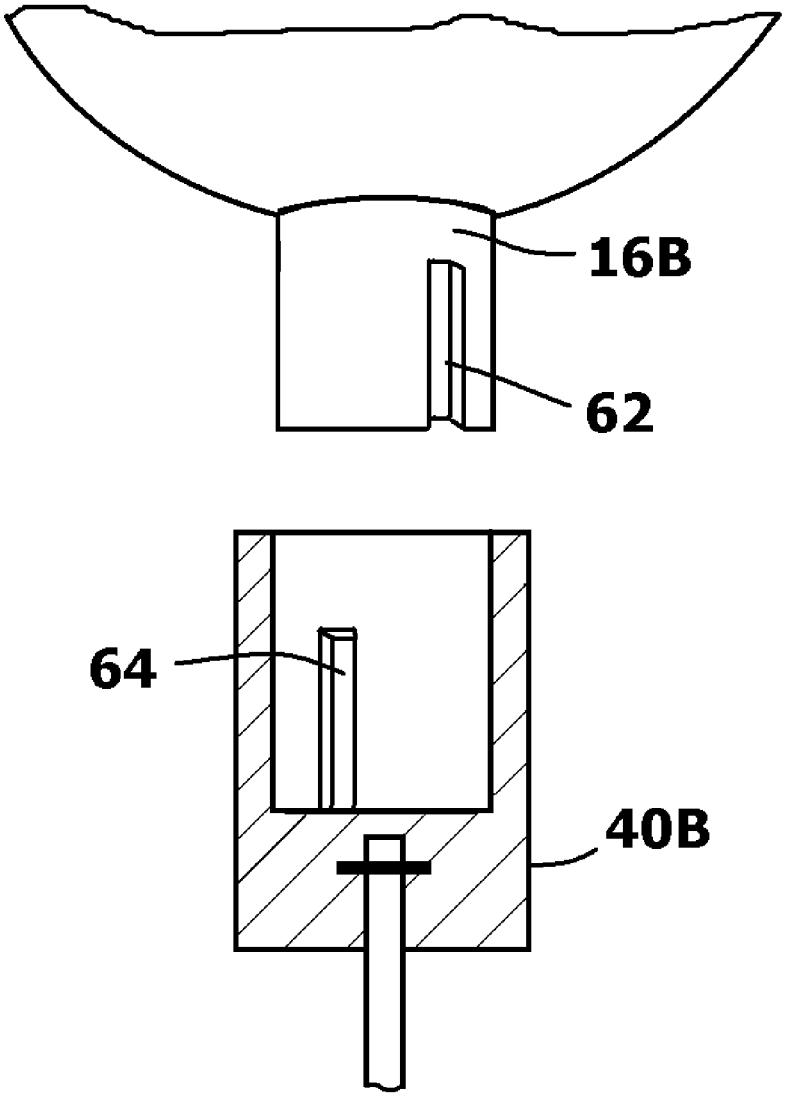
FIG. 5 is a fragmented cross-sectional view showing a neck of an ornament and a second exemplary embodiment of a mount.

Referring to FIG. 5, the neck 16B of a molded plastic hanging ornament is shown. To engage such a neck 16B, the mount 40B is configured with a receptacle 60 that receives a portion of the neck 16B and engages the neck 16B with a friction connection. Since the neck 16B of the hanging ornament is molded of plastic, it can be readily configured with a keyway, key slot, or other keying features 62, with the mount 40 having the opposite keying feature 64. In this manner there is no slippage between the mount 40 and the neck 16 as the mount 40 rotates and the ornament experiences various forces from being decorated.

Figure 6:
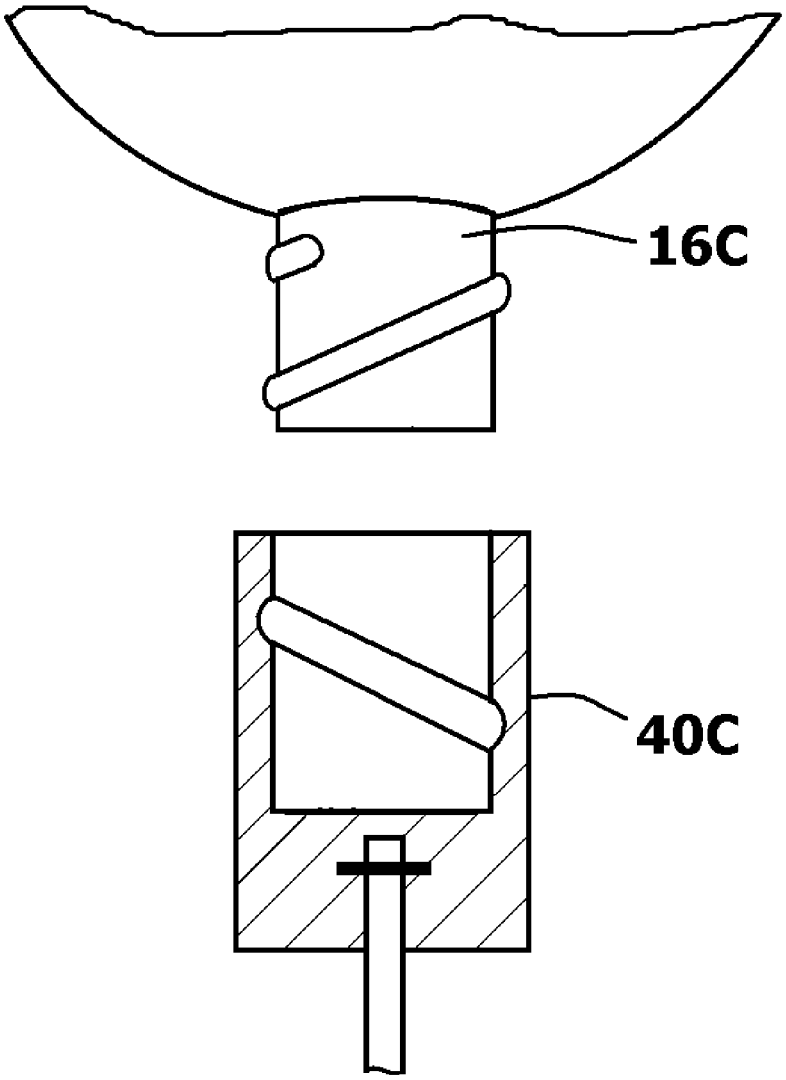
FIG. 6 is a fragmented cross-sectional view showing a neck of an ornament and a third exemplary embodiment of a mount.

Referring to FIG. 6, an example of a mount 40C that engages an ornament neck 16C with a mechanical connection is shown. In this embodiment, both the ornament neck 16C and the mount 40C are threaded. The threading tightens in the direction that the mount 40C rotates. In this manner, the neck 16C only needs to be brought into contact with the mount 40C as the mount is rotating. The mount 40C will thread onto the ornament neck 16C and create an interconnection as it begins to spin the ornament.

Referring back to FIG. 3, it will be understood that the mount 40 and the ornament neck 16 can have numerous other configurations, such as a bayonet connection, a puzzled interlock, or a magnetic interlock. What is of importance is that the neck 16 of the hanging ornament 12 has a firm interconnection with the mount 40 so that the central axis 18 of rotation for the neck 16 remains aligned with the rotational axis 42 for the mount 40 during the decorating process.

Figure 7:
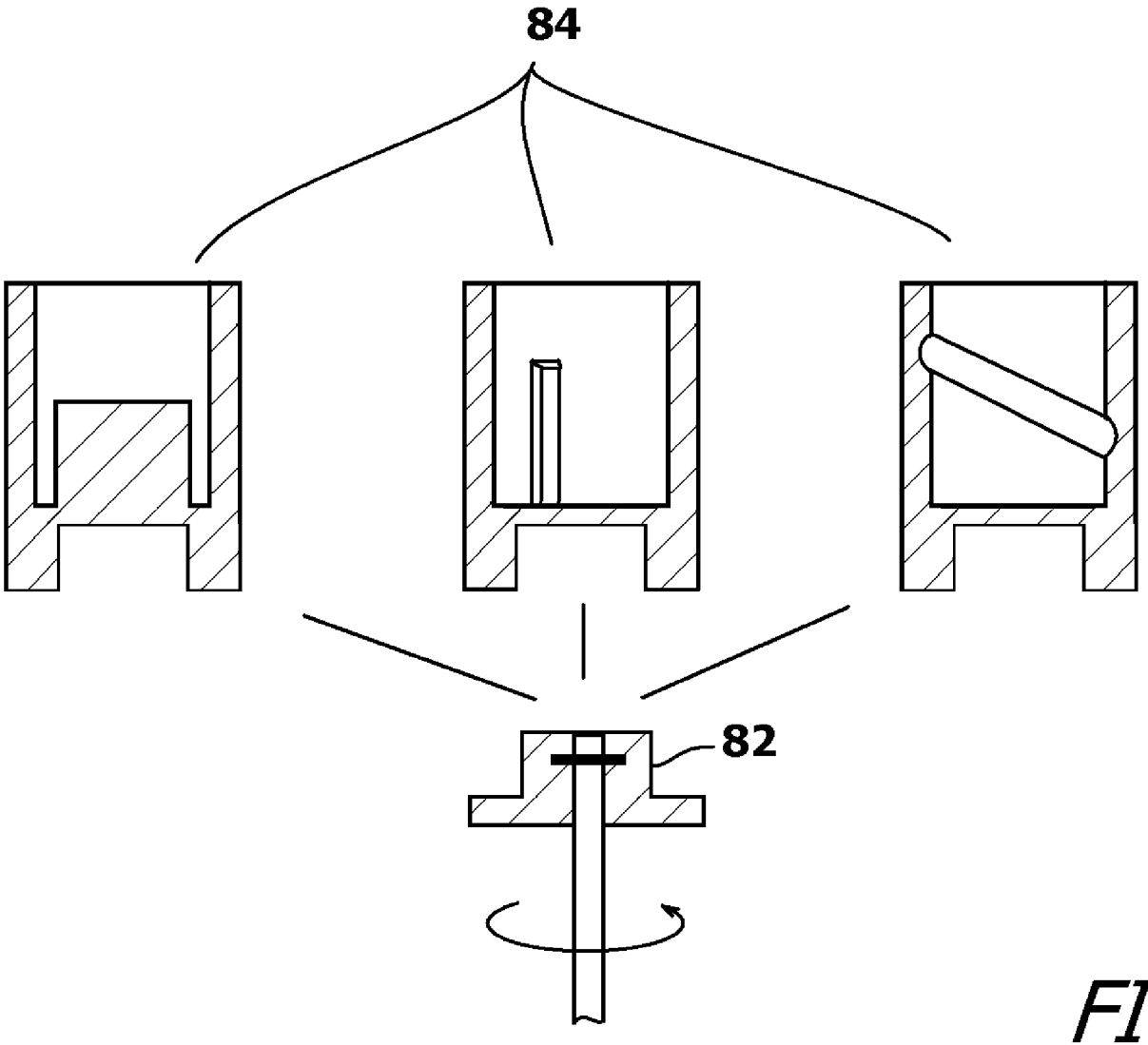
FIG. 7 is a fragmented cross-sectional view showing a neck of an ornament, and adapter and a plurality of mounts.

In the prior embodiments, it was assumed that the hanging ornament would have a neck that could be directly engaged by the mount. However, this need not be the case. Hanging ornaments come in different shapes and sizes and thus have necks of different shapes and sizes. Referring to FIG. 7, it will therefore be understood that an ornament decorating system can be provided that has a single rotating mount 82 and a plurality of adapters 84 that can be selectively attached to the mount 82. The adapters 84 are configured to engage various ornament necks of different sizes and shapes.

The embodiments of the present invention that are illustrated and described are merely exemplary and a person skilled in the art can make many variations to those embodiments. All such embodiments are intended to be included within the scope of the present invention as defined by the claims.

What is claimed is:

1. A system for rotating an ornament, comprising:

an ornament having a body and a neck, wherein said neck is disposed about a central axis;

a housing having an interior compartment and an access opening for accessing said interior compartment, wherein said access opening is sized to enable said body and said neck of ornament to pass through said access opening and into said interior compartment;

a mount disposed in said interior compartment of said housing that receives and engages said neck of said ornament, therein temporarily connecting said neck to said mount; and a motor for rotating said mount, wherein said mount rotates said ornament by said neck about said central axis, therein causing sections of said body to repeatedly rotate into and out of said interior compartment through said access opening.

2. The system according to claim 1, wherein said housing has a face surface and said access opening is disposed in said face surface.

3. The system according to claim 2, wherein said face surface is inclined relative said central axis to increase said sections of said ornament that extends out of said access opening.

4. The system according to claim 1, wherein said neck of said ornament mechanically interconnects with said mount and provides a sole point of contact with said ornament.

5. The system according to claim 1, wherein said neck of said ornament is keyed and connects to said mount to prevent independent rotation between said neck and said mount.

6. A system for rotating an ornament, wherein said ornament has a body and a neck, said system comprising:

a housing having a face surface, an interior compartment, and an access opening in said face surface that provides access to said interior compartment, wherein said access opening is sized to enable said body and said neck of said ornament to pass through said face surface;

a mount disposed within said housing that is sized to receive and retain said ornament and hold said ornament within said access opening; and a motor disposed within said housing for rotating said mount about a rotational axis.

7. The system according to claim 6, wherein said face surface is inclined relative to said rotational axis of said mount.

8. The system according to claim 6, further including a gearbox disposed between said motor and said mount.

9. The system according to claim 6, further including a battery compartment disposed within said housing.

10. The system according to claim 6, wherein said mount includes a keyed receptacle.

* * * * *